United States Patent [19]

Ban et al.

[11] Patent Number: 4,884,621

[45] Date of Patent: Dec. 5, 1989

[54] HYDRAULIC CONTROL METHOD FOR IMPLEMENTS

[75] Inventors: Keisuke Ban; Masakazu Sato; Bakugo Fujito, all of Utsunomiya; Kousuke Kikuchi, Wako, all of Japan

[73] Assignees: Honda Giken Kogyo Kabushiki Kaisha; Kabushiki Kaisha Teisan Industries, both of Tokyo, Japan

[21] Appl. No.: 205,252

[22] Filed: Jun. 10, 1988

[30] Foreign Application Priority Data

Jun. 13, 1987 [JP] Japan ..... 63-147712
Aug. 7, 1987 [JP] Japan ..... 62-196493

[51] Int. Cl.[4] ..... B22D 18/02

[52] U.S. Cl. ..... 164/4.1; 164/120; 164/154; 164/312; 164/319

[58] Field of Search ..... 164/120, 312, 457, 154, 164/155, 4.1, 319

[56] References Cited

U.S. PATENT DOCUMENTS 3,106,002 10/1963 Bauer .
4,446,907 5/1984 Suzuki et al. .
4,497,359 2/1985 Suzuki et al. .

FOREIGN PATENT DOCUMENTS 2522800 12/1975 Fed. Rep. of Germany ..... 164/155
48-7570 3/1973 Japan .
49-36093 9/1974 Japan .
57-171559 10/1982 Japan ..... 164/120
59-42169 3/1984 Japan ..... 164/154
2055316A 3/1981 United Kingdom .

*Primary Examiner*—Kuang Y. Lin
*Attorney, Agent, or Firm*—Armstrong, Nikaido Marmelstein, Kubovcik & Murray

[57] ABSTRACT

A method for controlling implements by means of a hydraulic pressure. A hydraulic pressure is fed from an accumulator to a first hydraulic circuit, after the operating pressure has been once lowered any arbitrary operating pressure or variation of the operating pressure is detected in the course of restoration to an initial set pressure, and a second hydraulic circuit is triggered by a detection signal based on this detection. In a secondary pressurization casting process to which this hydraulic control method is applied, when molten metal within an injection sleeve is filled under pressure within a cavity of a casting mold by means of an injection ram driven by an operating pressure of an accumulator, the injection ram is made to advance initially at a low speed and subsequently at a high speed, and while the introduction of the accumulator operation pressure to a hydraulic cylinder for driving the injection ram is sustained, a pressurizing rod is actuated after completion of filling of molten metal to make a secondary pressurizing force exert upon the molten metal. The operating pressure of the accumulator continues to lower in the course of advancing of the injection ram, and it begins to restore after the filling of molten metal into the cavity of the mold has been completed. Any arbitrary operating pressure or variation of the operating pressure in the course of restoration of the operating pressure is detected, and a hydraulic circuit for driving the pressurizing rod is triggered on the basis of the detection signal to make the pressurizing rod advance into the cavity.

12 Claims, 6 Drawing Sheets

HYDRAULIC CONTROL METHOD FOR IMPLEMENTS

BACKGROUND OF THE INVENTION

The present invention relates to a method for controlling implements with a hydraulic circuit employing an accumulator, and more particularly to a method for controlling implements with first and second hydraulic circuits in which a particular condition of an object of control generated by the first hydraulic circuit is detected and the second hydraulic circuit is actuated on the basis of the detection signal.

For instance, in a secondary pressurization casting process of the type that a secondary pressurizing force is applied to molten metal filled within a cavity of a metal mold under pressure, the above-mentioned hydraulic control method is employed.

A pressurizing die casting process in which molten metal is poured into a cavity of a metal mold under high pressure, has been widely employed and practiced as a most suitable process for mass-production in the art of casting of aluminium alloys. This die casting process has a tendency that blow holes are liable to be produced in a thick wall portion of a product, a crystalline structure becomes coarse and degradation of a strength in the thick wall portion is resulted. In order to resolve this problem, a secondary pressurization casting process in which an additional pressurizing force (secondary pressurizing force) is exerted upon molten metal filled within a cavity of a metal mold under pressure before solidification, was proposed (for example, see Japanese Patent Publication No. 48-7570 (1973), Japanese Patent Publication No. 49-36093 (1974), U.S. Pat. No. 3,106,002, U.S. Pat. No. 4,446,907, U.S. Pat. No. 4,497,359 and UK Patent Application GB 2055316A ).

The die casting process has the characteristic nature that since molten metal within a pressurized injection sleeve is injected into a cavity of a metal mold in a jet-like manner through an extremely narrow injection path and then solidified, the time before completion of solidification is very short. Therefore, a latitude in timing for performing secondary pressurization is small, and it is difficult to define the timing for starting the pressurization. If this timing is wrong, not only the effect of pressurization cannot be attained, but also in the case where the secondary pressurization has been carried out after commencement of solidification, sometimes cracks may be produced at the pressurized portion.

In the prior art, various procedures were proposed, in which a position of an injection ram for pressurizing molten metal within an injection sleeve is detected by means of a position sensor or the like and the timing for secondary pressurization is defined by making use of the detection signal as a trigger signal. However, according to these proposed procedures, variation of detection accuracy caused by change of performance of a position sensor, change in a speed of an injection ram, change of a volume of molten metal and the like, is large, and so, it was impossible to practice the secondary pressurization under high reliability.

In addition, another procedure of the type that secondary pressurization is effected after the molten metal injected into a cavity has been pressurized at an increased pressure by jointly employing an injection cylinder and a pressure booster cylinder, in which the pressure in the injection cylinder is detected and the timing of the secondary pressurization is defined by making use of the detection signal as a trigger signal, was also known. However, according to the last-mentioned procedure, since the pressure within the injection cylinder which rises abruptly after completion of filling of molten metal is detected, the detection timing is unstable, and so, the time point for commencing the secondary pressurization could not be defined accurately.

SUMMARY OF THE INVENTION

The present invention has been worked out under the above-described technical background, and one object of the invention is, in a method for controlling implements by employing an accumulator in a hydraulic circuit, to perform triggering of another hydraulic circuit in a separate system at a high precision on the basis of an operating pressure of the accumulator.

The above-described object can be achieved by the method consisting of the steps of detecting an arbitrary operating pressure of an accumulator provided in a first hydraulic circuit or variation of the operating pressure during the period when the operation pressure is restored to its initial set pressure after the accumulator started to operate and its operation pressure has been once lowered, and triggering a second hydraulic circuit to operate on the basis of the detection signal.

When the accumulator provided in the first hydraulic circuit starts to operate, the operation pressure of the accumulator is lowered according to the movement of the object to be controlled, and after the object to be controlled has reached a desired state, the operating pressure begins to restore and returns to the initial set pressure. Accordingly, by sensing the start point of restoration of the operating pressure, one can know that the object to be controlled has reached the desired state.

According to the present invention, after an operating pressure of an accumulator has begun to restore, by sensing the operating pressure (smaller than the initial set pressure) before the restoration is completed, the second hydraulic circuit is triggered on the basis of the operating pressure serving as an index of timing. In the course of restoration of the operating pressure of the accumulator, the object of control by means of the first hydraulic circuit has already reached a desired state, and in the case where it is necessary to actuate an object of control by means of the second hydraulic circuit after the desired state has been reached, the beginning point of operation (the triggering point) of the object of control by means of the second hydraulic circuit can be defined always precisely by detecting the restoring operating pressure of the accumulator.

If this technical concept is applied to a secondary pressurization casting process, it becomes as follows:

When molten metal within an injection sleeve is filled under pressure into a cavity of a casting mold by means of an injection ram driven by an operating pressure of an accumulator, the injection ram is made to advance initially at a low speed and subsequently at a high speed, and while introduction of the accumulator operating pressure to a hydraulic cylinder for driving the infection ram is sustained, a pressurizing rod is actuated after completion of filling of molten metal to make a secondary pressurizing force exert upon the molten metal.

Alternatively, the injection ram may be made to advance initially at a low speed by means of other than the accumulator and subsequently at a high speed by introducing the operating pressure of the accumulator into an injection hydraulic cylinder for driving the injection ram.

The operating pressure of the accumulator continues to lower during the process of advancing of the injection ram, and it begins to restore after the filling of molten metal into the cavity of the casting mold has been completed. Any arbitrary operating pressure or variation of an operating pressure in the course of restoration of the operating pressure is detected, then on the basis of the detection signal the hydraulic circuit for driving a pressurizing rod is triggered, and thereby the pressurizing rod is made to advance into the cavity of the casting mold to apply a secondary pressurizing force to the molten metal.

According to the above-mentioned process, in which variation of an operating pressure of an accumulator is sensed and secondary pressurization is commenced by making use of this variation as an index of timing, the secondary pressurization can be performed at a higher precision in timing as compared to the case where the time point of completion of filling of molten metal is indirectly sensed by means of a position sensor or the like.

DETAILED DESCRIPTION OF THE PREFERRED EMBODIMENTS

In the following, the present invention will be described in greater detail with respect to its preferred embodiments as applied to a secondary pressurization casting process.

Figure 1:
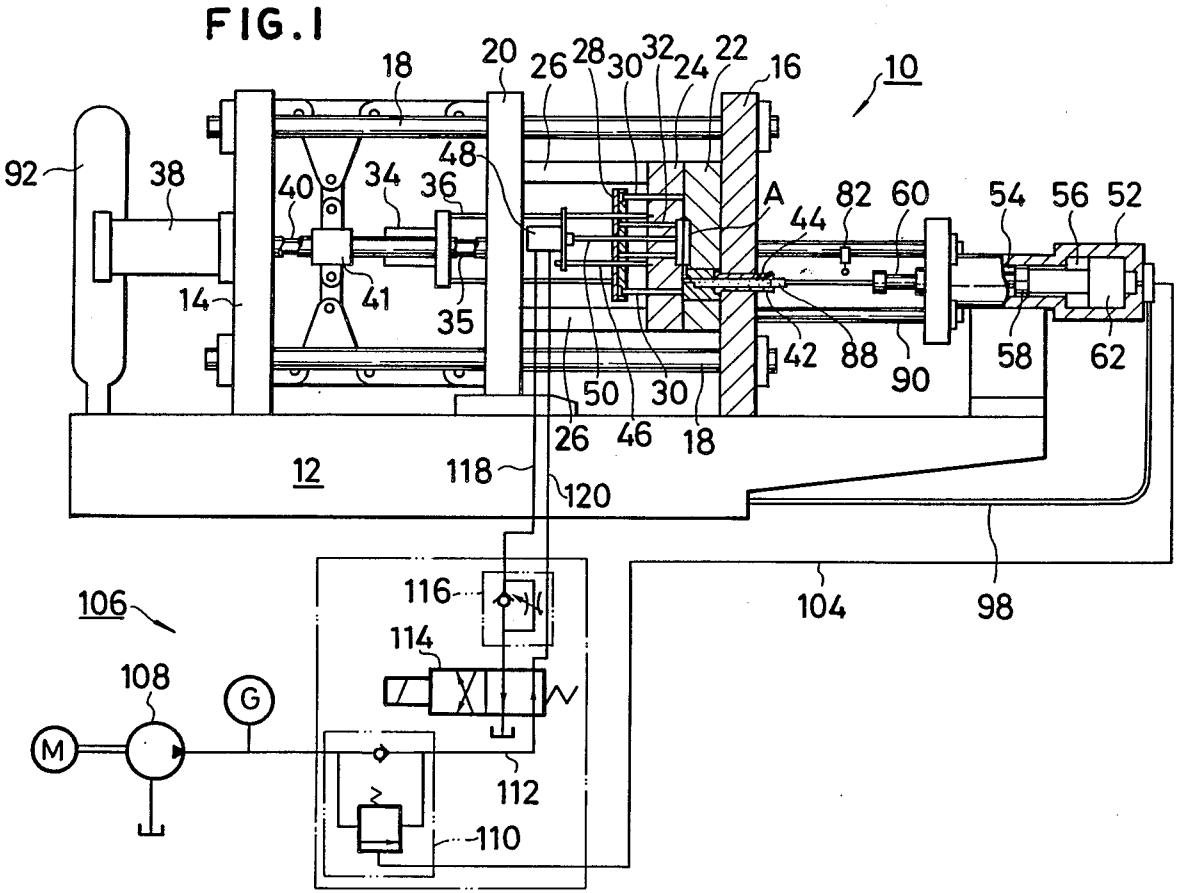
FIG. 1 is a schematic view partly cut away showing one example of a secondary pressurization casting apparatus that is favorable for practicing the method according to the present invention.

FIG. 1 shows a die casting apparatus 10 in which a secondary pressurizing force can be exerted, jointly with a hydraulic control system for secondary pressurization 106. On a base 12 of the die casting apparatus 10 are immovably erected fixed platens 14 and 16 which are coupled to each other by means of a plurality of connecting rods 18 and opposed to each other at an interval. In addition, there is provided a movable platen 20 that is positioned between the fixed platens 14 and 16 and can be slidably displaced along the base 12 as guided by the connecting rods 18.

Then, a fixed metal mold 22 is fixedly secured to the fixed platen 16, while a movable metal mold 24 is fixedly secured to the movable platen 20 via holders 26. A pair of push-out pins 32 which penetrate through the movable metal mold 24 and reach a cavity A to be used for separating a product after completion of casting from the movable metal mold, are fixedly secured to a push-out plate 28 having a pair of return pins 30 which penetrate through the movable metal mold 24 so as to be slidable and relatively displaceable, and this push-out plate 28 can be move relatively to the movable mold 24 in the direction for separating a product by means of push rods 36 which are connected to a base plate of a push-out hydraulic cylinder 34 that can move relatively to the movable platen 20 with the tip end of its piston rod 35 fixedly secured to the movable platen 20.

In addition, to the fixed platen 14 is fixed a hydraulic cylinder 38 for driving the movable platen, and the movable platen 20 can be moved by a push rod 40 having one end fixed to the piston of the hydraulic cylinder 38 and the other end fixed to a cross member 41.

Furthermore, an injection hydraulic cylinder 52 is fixed via support rods 90 to the fixed platen 16, an injection ram 88 connected to the injection piston 58 of the cylinder 52 is slidably and displaceably fitted in an injection sleeve 42 which penetrates through the fixed platen 16 and communicated with a molten metal path in the fixed metal mold, and the arrangement is such that after molten metal has been fed into the injection sleeve 42 through a molten metal pouring port 44, if the injection ram 88 is moved in the advancing direction by the actuation of the injection piston 58, the molten metal within the injection sleeve 42 may be pushed into the cavity A through the molten metal path.

On the other hand, from the movable metal mold 24 is supported a secondary pressurization hydraulic cylinder 48 via a pair of holding rods 46, and the arrangement is such that a pressurizing rod 50 connected to a piston of the secondary pressurization hydraulic cylinder 48 slidably and displaceably penetrates through the push-out plate 28 and the movable metal mold 24 so as to be able to project into the cavity A.

Figure 2:
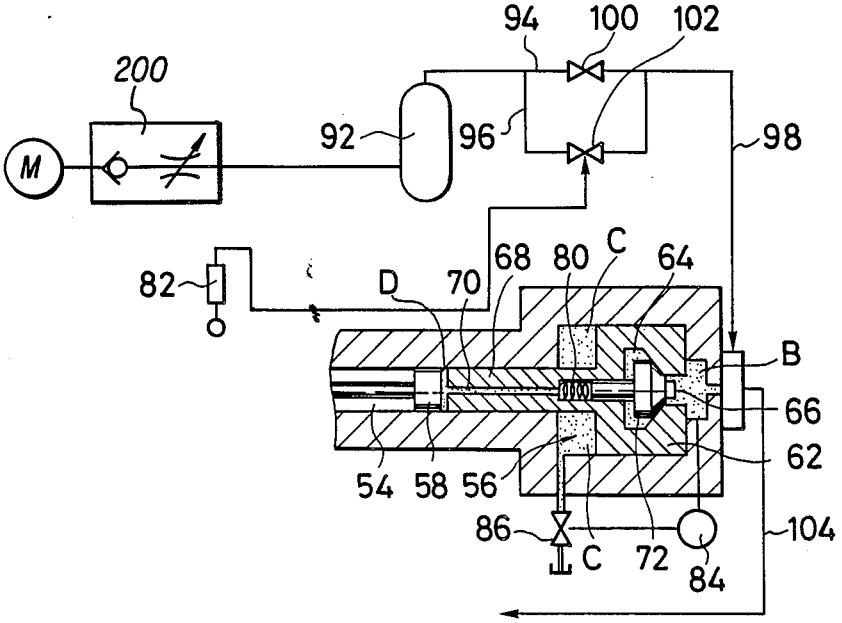
FIG. 2 is a schematic view showing a part of the apparatus in FIG. 1 in an enlarged scale jointly with an operating hydraulic circuit.
Figure 3:
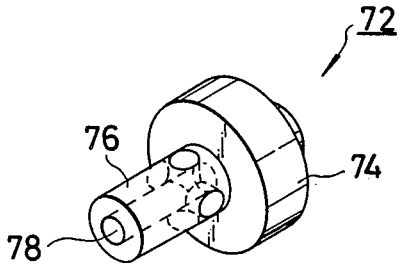
FIG. 3 is a perspective view of a check valve shown in FIG. 2.

The injection hydraulic cylinder 52 has a smaller diameter chamber 54 in which an injection piston 58 is fitted and a larger diameter 56 in which a pressure booster piston 62 is fitted. The pressure booster piston 62 is integrally provided with a rod 68 fitting in the smaller diameter chamber 54, and in this piston 62 are formed a valve chamber 64 for accommodating a check valve 72 and an oil path 70 communicated with the valve chamber 64 and extending through the rod 68 (FIG. 2). The check valve 72 is an umbrellashaped member consisting of a head portion 74 having a conical surface and a shaft portion 76 (FIG. 3), and it is biased towards the opposite side to the injection piston 58 (rightwards as viewed in FIG. 2) by means of a coil spring 80 accommodated also in the same valve chamber 64. An aperture 66 of the valve chamber 64 is blocked when the head portion 74 of the check valve 72 is pressed against the peripheral portion of the aperture 66. In the shaft portion 76 of the check valve 72 is formed an oil path 78 extending from its outer circumferential surface portion close to the head portion to its tip end portion, so that a flow of pressurized oil through the route consisting of the aperture 66 of the valve chamber 64 → the oil path 78 → the oil path 70 may be attained.

It is convenient for the sake of the subsequent explanation to define different portions of the inner chamber (the smaller diameter chamber 54 and the larger diameter chamber 56) of the injection hydraulic cylinder 52 as chamber-B facing to the aperture 66 of the valve chamber 64, chamber-C provided around the base portion of the rod 68 and delimited by the pressure booster piston 62 and the cylinder wall, and chamber-D that is created when the rod 68 and the injection piston 58 separate from each other. On the wall of the injection hydraulic cylinder 52 is provided an escape valve 86 communicating with the chamber-C, and this escape valve 86 is adapted to be opened in response to a detection signal issued from a pressure sensor 84 which detects the pressure in the chamber-B.

In addition, a position sensor 82 for detecting an amount of displacement of a rod 60 that is integral with the injection piston 58, is disposed at a predetermined position. Among the oil paths 94 and 98 communicating an accumulator 92 with the chamber-B, in the oil path 94 is interposed a low speed valve 100, and also in another oil path 96 provided in parallel to the oil path 94 is disposed a high speed valve 102 which is opened in response to a position signal issued from the above-described position sensor 82.

A hydraulic control system 106 for the secondary pressurization hydraulic cylinder 48 takes out an operating pressure of the injection hydraulic cylinder 52 through an oil path 104 and operates on the basis of this operating pressure. More particularly, a principal part of the hydraulic control system 106 is constructed such that a sequence valve 110 whose triggering pressure can be adjusted by making use of a biasing spring force is operated by the operating pressure of the injection hydraulic cylinder 52 led to the sequence valve 110, hence pressurized oil delivered from a hydraulic pump 108 is led to the secondary pressurization hydraulic cylinder 48 through an oil path 112, a switching valve 114, a flow rate requlation valve 116 and a pressurizing rod propelling oil path 118, and a pressurizing rod 50 projects into the cavity A. It is to be noted that the switching valve 114 is switched from the illustrated state simultaneously with feeding of pressurized oil into the chamber-B of the injection hydraulic cylinder 52 through an oil feed path 98.

In the above-described construction, after molten metal (for example, aluminium alloy) has been poured into the injection sleeve 42 through the molten metal pouring port 44, if the injection ram 88 is made to advance by actuating the injection hydraulic cylinder 52, then the molten metal within the injection sleeve 42 is injected under pressure into the cavity A to fill it. And after the cavity A has been completely filled, the pressurizing rod 50 is pushed into the molten metal within the cavity at a predetermined timing, and thereby a secondary pressurizing force is applied to the molten metal.

In the following, description will be made on the operations of the injection hydraulic cylinder 52 and the hydraulic control system 106:

① Before Commencement of Injection: the state of the injection hydraulic cylinder 52 before commencement of injection is shown in FIG. 2. The low speed valve 100 and the high speed valve 102 are both closed in this state. The injection piston 58 and the pressure booster piston 62 are at the most retracted position, and the check valve 72 of the pressure booster piston 62 blocks the aperture 66 of the valve chamber 64 as biased by means of a coil spring 80.

Figure 4:
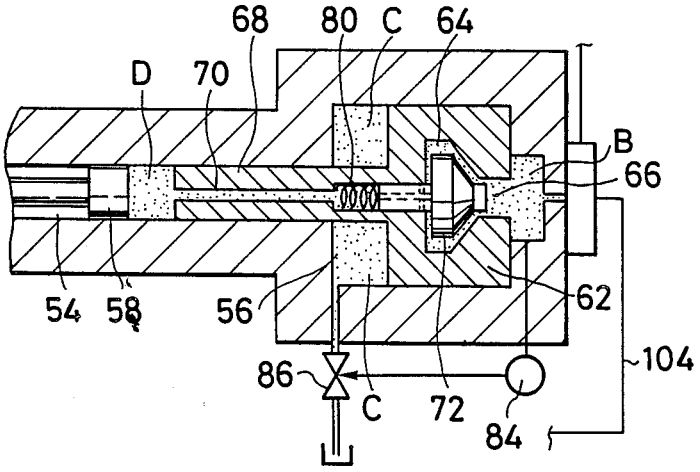
FIG. 4 and 5 are schematic views similar to FIG. 2 but showing different operating states of the same secondary pressurization casting apparatus.
Figure 6:
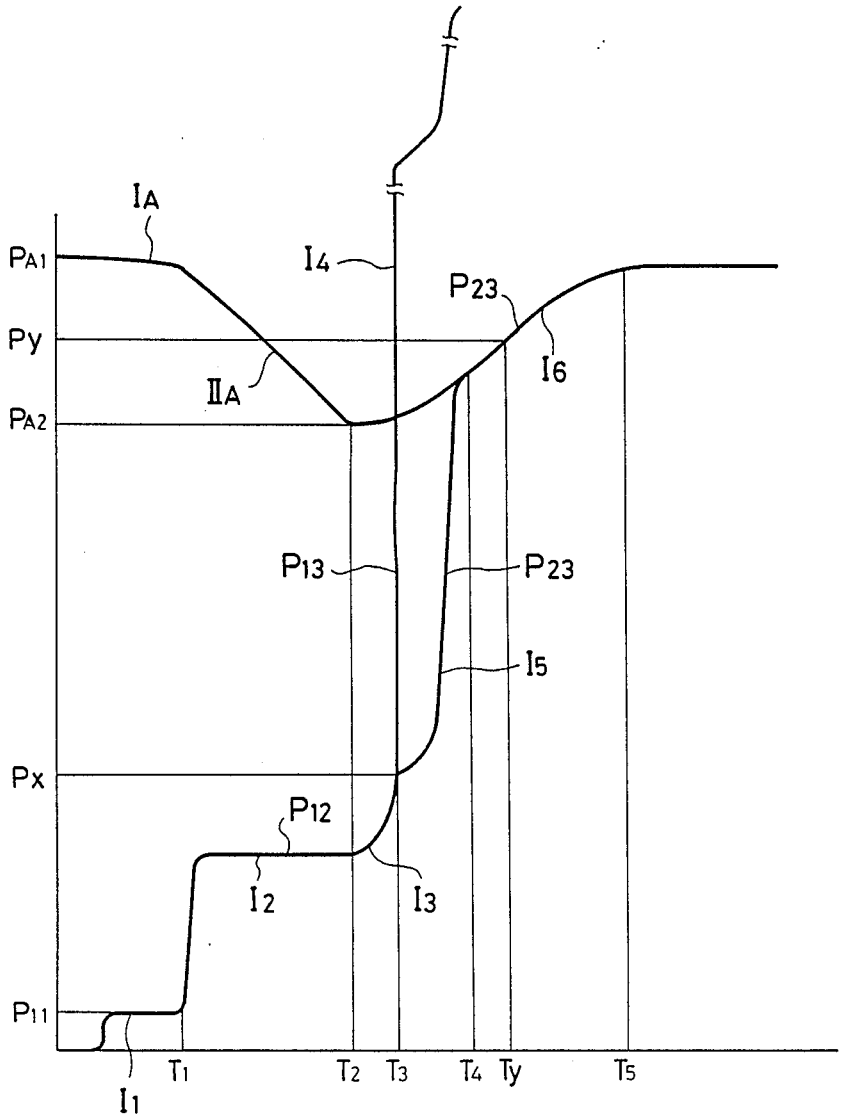
FIG. 6 is a diagram showing variation of a hydraulic pressure within an injection hydraulic cylinder in the same secondary pressurization casting apparatus as well as variation of an operating pressure of an accumulator in the same apparatus.

② Commencement of Injection (Low Speed Injection): The low speed valve 100 is opened. Then, oil delivered from the accumulator 92 which has been already in a standby state is fed to the chamber-B through the oil paths 94 and 98, hence an oil pressure within the chamber-B rises, so that the check valve 72 is moved against the biasing force of the coil spring 80, thus the route consisting of the chamber-B → the oil path 78 formed in the shaft portion 76 of the check valve 72 → the oil path 70 formed in the rod 68 of the pressure booster piston 62 becomes a conducting state, and pressurized oil (at a pressure $P_{11}$) is fed to between the injection piston 58 and the rod 68. The injection piston 58 is made to advance at a low speed (a low speed as compared to the high speed advance in the next step: See curve $I_1$ in FIG. 6) by the hydraulic pressure ($P_{11}$) acting upon a head top surface of the piston 58, and thereby the chamber-D is formed between the injection rod 58 and the rod 68 (FIG. 4). Meanwhile, the delivery operating pressure of the accumulator 92 is gradually lowered from its initial set pressure $P_{A1}$ due to dissipation of energy (see curve $I_A$ in FIG. 6).

③ High Speed Injection: When the injection piston 58 has advanced by a predetermined length (hence the injection ram 88 has advanced by a predetermined length), the position sensor 82 is actuated as a result of contact with the rod 60 formed integrally with the injection piston 58, the high speed valve 102 is opened by the detection signal issued from the position sensor 82, thus the feed rate of the working oil of the accumulator 92 to the chamber-B and the chamber D is increased, so that the pressure within the chamber-B and the chamber-D rises abruptly (curve $I_2$, pressure $P_{12}$ and time point $T_1$), and the injection piston 58 advances at a high speed. During this period, the operating pressure of the accumulator 92 is lowered with a large gradient (curve $II_A$) as compared to curve $I_A$, the operating pressure ($P_{A2}$) at the time point ($T_2$) of completion of filling of molten metal becomes the lowest value, and thereafter the operating pressure begins to rise (commencement of restoration of the operating pressure).

④ Pressure Boosting Step: After completion of the filling of molten metal, although the oil pressures within the chamber-B and the chamber-D must rise quickly, initially it rises slowly (curve $I_3$, pressure $P_{12}$) due to the fact that the molten metal within the molten metal path and the injection sleeve 42 begins to solidify and contract, hence the injection ram 88 and the injection piston 58 still advance (though the advance is little) and also there is a delay in the rise of the oil pressure. When the pressure within the chamber-B ($P_{12}$: equal to the pressure within the chamber-D) has risen up to $P_x$ (time point $T_3$), that pressure ($P_x$) is detected as a set pressure by means of the pressure sensor 84, and the escape valve 86 is opened in response to the detection signal.

Figure 5:
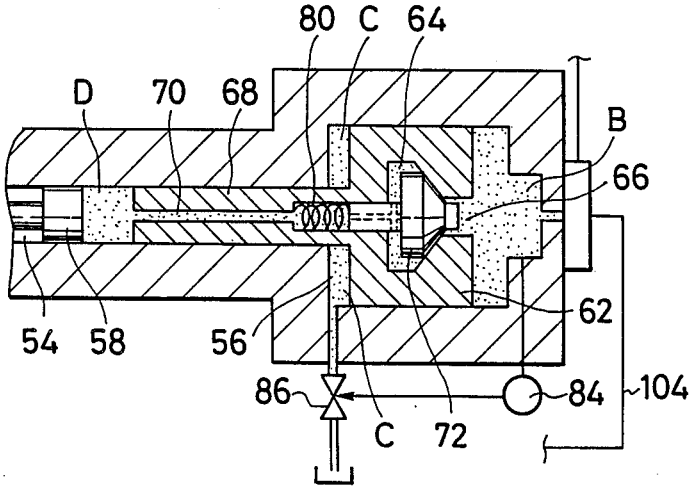

The pressurized oil within the chamber-C is discharged externally through the escape valve 86, and the pressure booster piston 62 begins to advance. As a result, the pressure within the chamber-D becomes higher than the pressure within the chamber-B, hence the check valve 72 is pushed to the aperture potion 66 of the valve chamber 64 to block that aperture 66, thus the pressure booster piston 62 advances under the condition where the communication between the chamber-B and the chamber-D is cut off (FIG. 5), and the pressure within the chamber-D rises quickly (curve $I_4$, pressure $P_{13}$).

The rising speed of the pressure ($P_{13}$) within the chamber-D after the time point $T_3$ is sufficiently large as compared to the rising speed of the pressure ($P_{23}$) within the chamber-B (See curves $I_4$ and $I_5$), and even during this period the injection piston 58 as well as the pressure booster piston advance slightly.

The pressure ($P_{23}$) within the chamber-B coincides with the operating pressure of the accumulator 92 which is in the course of restoration at the time point ($T_4$), and thereafter the pressure ($P_{23}$) within the chamber-B is equal to the operating pressure of the accumulator 92 (curve $I_6$), and the operating pressure of the accumulator 92 restores to the initial set pressure ($P_{A1}$) at the time point ($T_5$).

It was described previously that the operating pressure of the accumulator 92 restores after it has been lowered from the pressure ($P_{A1}$) to the pressure ($P_{A2}$). By detecting in the chamber-B a preselected pressure ($P_y$) during the period from the time point ($T_4$) when variation of the pressure ($P_{23}$) within the B-chamber that is equal to the operating pressure of the accumulator 92 is stabilized up to the time point ($T_5$) (See curve $I_6$), one can know the timing for commencing quick secondary pressurization after completion of filling the cavity A with molten metal.

⑤ Commencement of Secondary Pressurization: The pressure within the chamber-B (the operating pressure of the accumulator 92) is led through the oil path 104 to the sequence valve 110 in the hydraulic control system 106, and when the pressure within the chamber-B has reached the above referred predetermined pressure $P_y$ ($P_{A2} \leqq P_y < P_{A1}$), the sequence valve 110 is opened. As a result, under the condition where the switching valve 114 has displaced from the state shown in FIG. 1, delivery oil of the hydraulic pump 108 is fed through the sequence valve 110, the oil path 112, the switching valve 114, the flow rate requlating valve 116 and the pressurizing rod propelling oil path 118 to a high pressure chamber of the secondary pressurization hydraulic cylinder 48, hence the pressurizing rod 50 is made to advance and is pushed into the molten metal filling the cavity A, and thereby a secondary pressurizing force is applied to the above-mentioned molten metal which has not yet completed solidification.

The secondary pressurizing force is applied until the molten metal within the cavity A finishes to solidify, thereafter by switching the switching valve 114, pressurized oil is fed to the secondary pressurization hydraulic cylinder 48 through the other oil path 120 for retracting the pressurizing rod, and thereby the pressurizing rod 50 is retracted.

In the above-described operations, it is preferable that the pressure ($P_y$) is selected so as to satisfy the following formula.

$$O < P_y - P_{A2} \leqq 0.8(P_{A1} - P_{A2})$$

A range of $P_y - P_{A2} > 0.8\ (P_{A1} - P_{A2})$ is just before the complete restoration of the operating pressure of the accumulator when the restoring speed is very slow, so that detecting accuracy of the time point ($T_y$) deteriorates.

In addition, the time interval between the time point ($T_2$) and ($T_y$) is preferably set as $T_y - T_2 > 0.2$ sec.. If the time interval is set as $T_y - T_2 < 0.2$sec., it is too early to commence the secondary pressurization owing to occurrence of a back-flowing of the molten metal. If the secondary pressurization is performed very soon after the cavity A has been filled with the molten metal, there is a possibility that the molten metal in the molten metal path between the cavity A and the injection sleeve 42 is not solidified yet completely and a back-flowing of the molten metal occurs by the secondary pressurizing force which is larger than the filling pressure of the molten metal.

Consequently, it is desirable that the molten metal within the injection sleeve 42 is further subjected to a larger pressure than the pressure at the completion of the filling before the secondary pressurization is performed. By such a further pressurization after the completion of the filling, effect of the secondary pressurization can be made sure and a cast product having a fine structure is obtainable.

Characteristic points of the above-described embodiment will be enumerated in the following:

① The above-described embodiment utilizes the phenomena that the operating pressure of the accumulator 92 for driving the injection piston 58 lowers gradually after the low speed valve 100 has been opened, it continues to lower at a higher speed after the higher speed valve 102 has been opened, and it begins to restore at the time point ($T_2$) when the filling of molten metal has been completed, and by sensing the operating pressure ($P_y$: a pressure that can be detected within the chamber-B) of the accumulator 92 during the period from the time point ($T_2$) when the operating pressure of the accumulator begins to restore until the time point ($T_5$) when the restoration is completed, especially during the period from the time point ($T_4$) when the pressure ($P_{23}$) within the chamber-B and the operating pressure of the accumulator 92 coincide with each other until the time point ($T_5$), the sequence valve 110 can be opened to commence the secondary pressurization at a highly precise timing having little fluctuation.

② If the operating pressure of the accumulator 92 during the period from the time point ($T_2$) when the filling of molten metal has completed until the time point ($T_4$) when the pressure ($P_{23}$) within the chamber-B and the operating pressure of the accumulator 92 coincide with each other, is detected in the accumulator 92 rather than in the chamber-B, then the triggering point for commencing the secondary pressurization can be sensed at an earlier timing after the completion of filling of molten metal, as compared to the case where the operating pressure ($P_y$) of the accumulator 92 during the period from the time point ($T_4$) until the time point ($T_5$) is detected. Therefore, it is also possible to utilize the operating pressure of the accumulator 92 during the period from the time point ($T_2$) until the time point ($T_4$) as a triggering pressure for commencing secondary pressurization. In this case however, it is impossible to sense the variation of the operating pressure of the accumulator 92 at the chamber-B where the variation of the molten metal pressure can be directly sensed.

③ Since the operating pressure of the accumulator 92 restores relatively slowly, variation of the triggering time point for the sequence valve 110 that is preset to be triggered at the pressure ($P_y$) is small, hence after completion of filling of the molten metal, the secondary pressurization can be performed always at the correct predetermined timing.

④ As the triggering of the sequence valve 110 is effected by directly leading the oil pressure in the chamberB, time delay is little as compared to the case where the pressure within the chamber-B is detected by a pressure detector and a solenoid valve is actuated on the basis of that detection signal to operate a secondary pressurization hydraulic cylinder, and so the timing of secondary pressurization can be correctly set.

⑤ By preliminarily adjusting a degree of opening of a pressurized oil feed valve 200 for the accumulator 92, it is possible to regulate and change the restoration speed of the operating pressure of the accumulator 92 after it has once lowered, hence the time point for detecting the operating pressure ($P_y$) can be simply changed by regulating the pressurized oil feed valve, and the timing of secondary pressurization can be easily adjusted.

⑥ The feed rate of pressurized oil to the secondary pressurization hydraulic cylinder 48 can be selected or changed by regulating a degree of opening of the flow rate regulation valve 116, and therefore, proper secondary pressurization can be achieved by making the pressurizing rod 50 advance at a speed adapted to material, shape, size, etc. of a cast product.

⑦ While the operating pressure ($P_y$) of the accumulator 92 in the course of restoration was sensed and the sequence valve 110 was triggered by making use of the pressure ($P_y$) as a trigger signal in the above-described embodiment, modification could be made such that the time point ($T_2$) of completion of filling of molten metal (the lower limit operating pressure ($P_{A2}$)) is employed as a reference and the sequence valve 110 is opened after a predetermined period from the reference time by means of a delay timer or the like.

Figure 7:
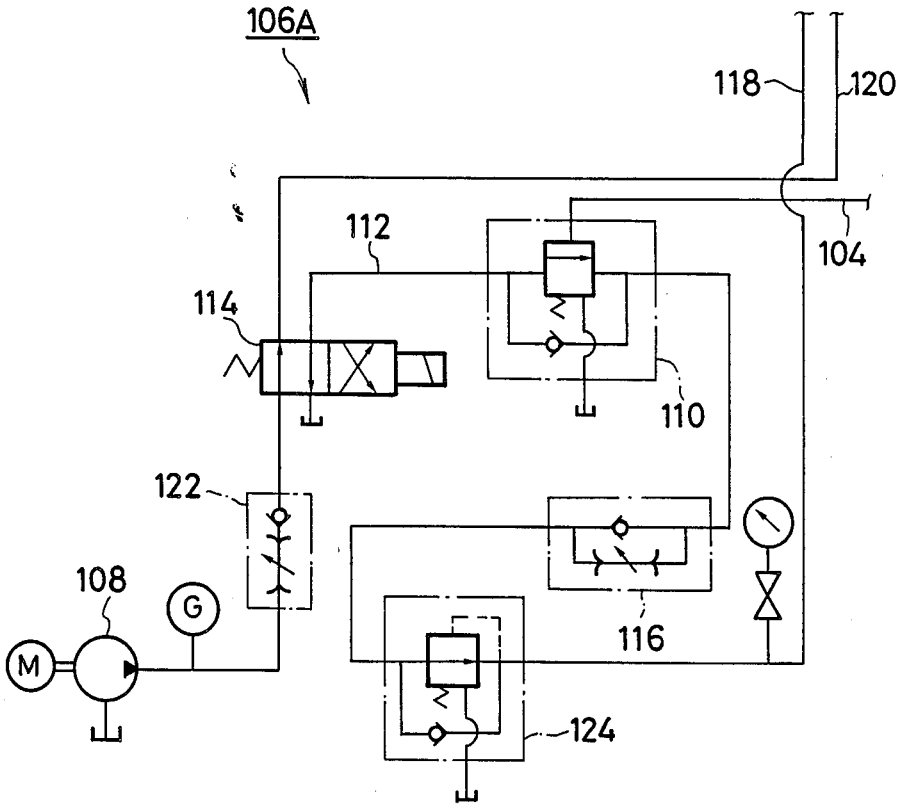
FIG. 7 is a schematic view showing a hydraulic control system which is a partial modification of the hydraulic control system in the above-described secondary pressurization casting apparatus.

Now description will be made on a hydraulic control system 106A according to a modified embodiment illustrated in FIG. 7. In this figure, component parts similar to those shown in FIG. 1 are given like reference numerals.

In the hydraulic control system 106A, in addition to the sequence valve 110, the switching valve 114 and the flow rate regulating valve 116 in the previously described embodiment, a stop valve 122 between a hydraulic pump 108 and the switching pressurization hydraulic cylinder 48 are used.

According to the hydraulic control system 106A, as soon as the delivery oil from the accumulator 92 is led into the injection hydraulic cylinder 52, the switching valve 114 is switched from the illustrated state, hence the pressurized oil fed from the hydraulic pump 108 becomes a standby state at the inlet port of the sequence valve 110, and when the sequence valve 110 is opened, the pressurized oil kept in a standby state is led quickly through the flow rate regulating valve 116 and the pressure reduction valve 124 to the secondary pressurization hydraulic cylinder 48.

The advancing speed of the pressurizing rod 50 can be selected at or changed to a proper value by adjusting the flow rate regulating valve 116, and the secondary pressurizing force can be selected at or change to a proper value by adjusting the pressure reduction valve 124.

Figure 8:
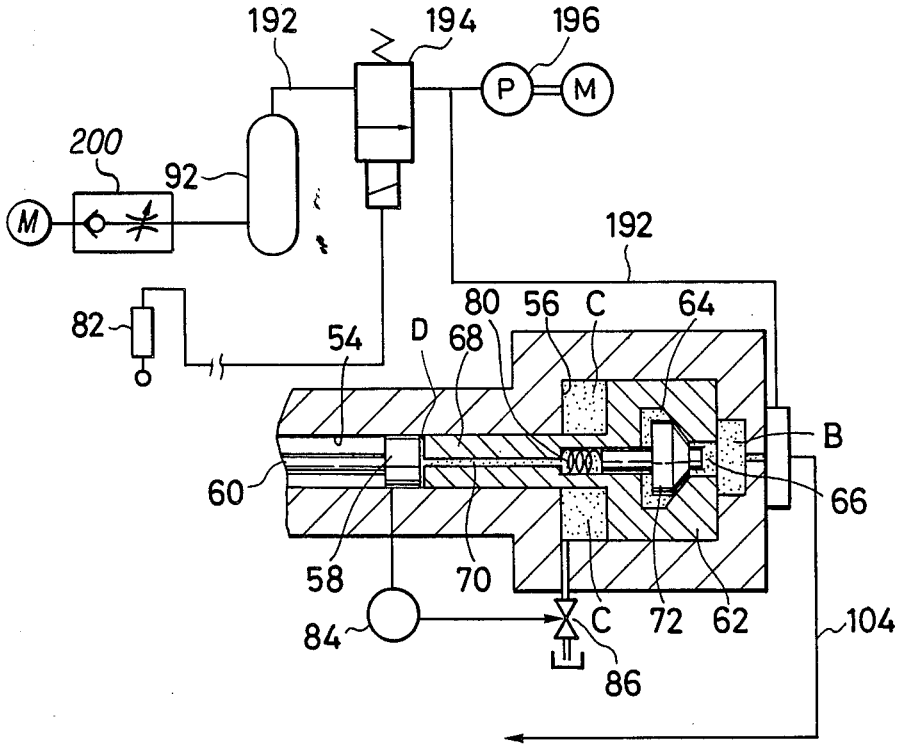
FIG. 8 is a schematic view similar to FIG. 2 but showing a modification of the above described operating hydraulic circuit.

FIG. 8 is a schematic view similar to FIG. 2 but showing a modification to the operating hydraulic circuit for feeding working oil to the injection hydraulic cylinder 52, in which component parts similar to those shown in FIG. 2 are given like reference numerals. In this modification, a sequence valve 194 adapted to be opened in response to a position signal issued from a position sensor 82 is interposed in an oil feed path 192 for communicating the accumulator 92 with the chamber-B, and a hydraulic pump 196 is communicatively connected to the oil feed path 192 between the sequence valve 194 and the chamber-B. Before commencement of injection, the sequence valve 194 is closed. Under this condition, if the hydraulic pump 196 is started, delivery oil of that pump is fed through the oil feed path 192 to the chamber-B, and low speed injection is commenced. Subsequently, the sequence valve 194 is opened in response to a signal issued from the position sensor 82, the operating pressure of the accumulator 92 is introduced to the chamber-B, and high speed injection is commenced. Furthermore, in this modified embodiment, a pressure sensor 84 detects the pressure within the chamber-D, and the escape valve 86 is adapted to be opened by this detection signal.

In addition, as another example to which the present invention is applicable, one can point out a molten metal forging process. As one type of molten metal forging process, a process is known, in which a hydraulic cylinder apparatus for feeding molten metal is operated by making use of a hydraulic circuit including an accumulator, and after molten metal has been filled within a cavity of a mold, the molten metal is pressurized by driving a forging plunger at a predetermined timing, and as another type of process, for instance, in the case of providing a cast product having a complex shape, a process is known in which a forging plunger for pressurizing molten metal poured into a cavity is driven by making use of an operating pressure of an accumulator, and after pressurization of the molten metal by means of the above-mentioned forging plunger, pressurization of detailed portions is effected by means of another forging plunger at a predetermined timing. To these processes also, the procedure according to the present invention that after an operating pressure of an accumulator in a first hydraulic circuit has once lowered, a second hydraulic circuit (a hydraulic circuit for driving a forging plunger) is triggered at a predetermined timing, can be applied.

As will be apparent from the above description, a hydraulic control method for implements characterized in that after an accumulator provided in a first hydraulic circuit is triggered and its operating pressure has once lowered, any arbitrary operating pressure or change of the operating pressure in the coarse of restoration to an initial set pressure is detected and a second hydraulic circuit is triggered on the basis of that detection signal, has been proposed.

According to this method, owing to the facts that it utilizes the phenomena that after commencement of operation of an accumulator provided in a first hydraulic circuit, the operation pressure is once lowered due to energy dissipation, and after the object to be controlled by the first hydraulic circuit has reached a predetermined target state, the same operating pressure restores to the initial set pressure, and that any arbitrary operating pressure or variation of the operating pressure during the period from the time point when the operating pressure of the accumulator begins to restore until completion of the restoration is detected and the second hydraulic circuit is triggered on the basis of that detection signal, an object to be controlled by the second hydraulic circuit can be controlled at a highly precise timing having little fluctuation as correctly matched with the state of the object to be controlled by the first hydraulic circuit.

In addition, the restoring speed of the operating pressure of the accumulator is relatively slow, and so, a trigger signal for triggering the second hydraulic circuit can be derived at a high precision and easily.

What is claimed is:

1. A hydraulic control method for implements, comprising the steps of:

employing an accumulator in a first hydraulic conduit;

triggering said first hydraulic circuit resulting in a lowering of an initial operating pressure of said accumulator;

sensing a restoration of the pressure of said accumulator after the lowering of the initial operating pressure; and triggering a second hydraulic circuit in response to the restoration of the pressure of said accumulator.

2. A hydraulic control method according to claim 1, wherein the sensing of the restoration of pressure of said accumulator is performed by sensing one of a predetermined operating pressure of said accumulator and a variation of operating pressure of said accumulator.

3. A hydraulic control method according to claim 2, including controlling a sequence valve, communicatively connected to a hydraulic pressure source, by the sensing of the predetermined operating pressure of said accumulator to open said sequence valve and actuate said second hydraulic circuit.

4. A hydraulic control method according to claim 3, including selecting a piston advancing speed of a hydraulic cylinder apparatus, which is controlled by said second hydraulic circuit by adjusting a degree of opening of a flow rate regulating valve for regulating a feed rate of pressurized oil to said hydraulic cylinder apparatus, and selecting a piston advancing pressure in said hydraulic cylinder apparatus by adjusting a degree of opening of a pressure regulation valve for regulating pressure of the pressurized oil to said hydraulic cylinder apparatus.

5. A metal mold casting process, comprising the steps of:

filling a cavity of a metal mold with molten metal injected from an injection sleeve containing molten metal by means of an injection ram;

advancing said injection ram initially at a low speed;

advancing said injection ram subsequently at a high speed by introducing hydraulic fluid from an accumulator into an injection hydraulic cylinder for driving said injection ram;

sensing a restoration of the pressure of said accumulator after a lowering of a initial operating pressure of said accumulator resulting from advancing said injection ram; and operating a pressurized rod, after completion of filling of the metal mold in response to the restoration of the pressure of said accumulator, to apply a secondary pressurizing force on the molten metal contained within said metal mold while sustaining the introduction of hydraulic fluid from said accumulator into said injection hydraulic cylinder.

6. A metal mold casting process according to claim 5, wherein the sensing of the restoration of pressure of said accumulator is performed by sensing one of a predetermined operating pressure of said accumulator and a variation of operating pressure of said accumulator.

7. A metal mold casting process according to claim 6, including adjusting a degree of opening of a pressurized oil feed valve for said accumulator so as to allow adjustment of a restoration speed of said accumulator operating pressure and to properly set a timing for commencement of operation of said pressurizing rod.

8. A metal mold casting process according to claim 6, wherein said injection ram is advanced at low speed by hydraulic fluid from said accumulator.

9. A metal mold casting process according to claim 8, including adjusting a degree of opening of a pressurized oil feed valve for said accumulator so as to allow adjustment of a restoration speed of said accumulator operating pressure and to properly set a timing for commencement of operation of said pressurizing rod.

10. A hydraulic control method for implements, comprising the steps of:

employing an accumulator having an initial operating pressure in first hydraulic circuit;

triggering said first hydraulic circuit resulting in a lowering of the initial operating pressure of said accumulator;

sensing at least one of an arbitrary operating pressure of the accumulator and a variation of operating pressure of the accumulator during a course of restoration to the initial operating pressure; and triggering a second hydraulic circuit in response said sensing.

11. A hydraulic control method according to claim 10, said triggering including directing said arbitrary operating pressure in the course of restoration of the pressure of said accumulator to a sequence valve that is communicatively connected to a hydraulic pressure source to open said sequence valve and actuate said second hydraulic circuit.

12. A hydraulic control method according to claim 11, including selecting a piston advancing speed of a hydraulic cylinder apparatus, which is an object to be controlled by said second hydraulic circuit, by adjusting a degree of opening of a flow rate regulating valve for regulating a feed rate of pressurized oil to said hydraulic cylinder apparatus.

* * * * *